US006494796B2

(12) United States Patent
Echaves

(10) Patent No.: US 6,494,796 B2
(45) Date of Patent: Dec. 17, 2002

(54) GOLF TEE TETHER

(76) Inventor: Bruce M. Echaves, 22 Transom Ct., Elkton, MD (US) 21921

( * ) Notice: Subject to any disclaimer, the term of this patent is extended or adjusted under 35 U.S.C. 154(b) by 0 days.

(21) Appl. No.: 09/985,103

(22) Filed: Nov. 1, 2001

(65) Prior Publication Data

US 2002/0094887 A1 Jul. 18, 2002

Related U.S. Application Data

(60) Provisional application No. 60/261,856, filed on Jan. 17, 2001.

(51) Int. Cl.[7] ..... A63B 57/00
(52) U.S. Cl. ..... 473/393; 473/396
(58) Field of Search ..... 473/387–403, 473/386; D21/718, 719; 224/918

(56) References Cited

U.S. PATENT DOCUMENTS 1,597,740 A * 8/1926 Thompson ..... 473/394
1,631,270 A * 6/1927 Jones ..... 473/391
1,638,448 A 8/1927 Manson
1,670,123 A * 5/1928 Ranseen ..... 473/394
1,800,647 A 4/1931 Krafft
1,948,284 A 2/1934 Breitbarth
3,743,298 A 7/1973 Reynolds
4,336,940 A * 6/1982 Sprague ..... 473/396
D349,318 S 8/1994 Rubin
5,413,348 A 5/1995 Basso
6,056,651 A * 5/2000 Malinoff ..... 473/398

* cited by examiner

*Primary Examiner*—Steven Wong
(74) *Attorney, Agent, or Firm*—Stephen R. Greiner

(57) ABSTRACT

A tee tether including a retaining clip for fastening to a golf tee, an anchoring peg for insertion into the ground remote from the clip, and a flexible cord connecting the clip and the peg. The retaining clip includes a lower member having a receptacle at its outer end with a conical aperture for snugly receiving the head of a golf tee and a first retaining arm extending from the receptacle. An upper member has a cap normally positioned above the receptacle and a second retaining arm extending from the cap substantially parallel to the first retaining arm. The cap has a concavity in its top for receiving and supporting a golf ball.

7 Claims, 1 Drawing Sheet

GOLF TEE TETHER

For priority purposes, this application claims the benefit of Provisional Application for Patent, Serial No. 60/261,856, filed Jan. 17, 2001.

FIELD OF THE INVENTION

The present invention relates generally to games using tangible projectiles and, more particularly, to golf tee tethers.

BACKGROUND OF THE INVENTION

In executing some golf shots, a tee is used to elevate a golf ball above the ground for striking by the head of a club. As is well known, a traveling club head will often contact the tee along with the ball, sending both flying. Frequently, finding a just-struck tee is made difficult by long grass within which the tee may fall and bury itself and, also, by a profusion of discarded, broken tees left behind by other golfers. Because finding of one's own tee on a golf course can be a "needle in a haystack" proposition, a need presently exists for an uncomplicated device that makes finding a golf tee an easy task on a golf course.

SUMMARY OF THE INVENTION

In light of the problems associated with golfers losing tees after striking a ball, it is a principal object of the invention to provide a tethering device that retains a tee in close proximity to golfers after making drives. Use of the device makes finding tees easy and makes lost tees a thing of the past.

It is an additional object of the invention to provide a golf tee tether of the type described that elevates a golf ball on a tee for easier striking with a golf club. Thus, the golf tee tether increases the effective height of a tee to which it is attached.

It is another object of the invention to provide a golf tee tether of the type described that can be employed as either a stance aid by assisting a golfer in positioning his feet at the optimal distance from the ball or a sighting aid by permitting a golfer to better aim a shot at a desired target.

It is a further object of the invention to provide a tee tether as described above that serves to partially absorb impacts from golf club heads thereby limiting damage to golf tees. Use of the tee tether, then, can increase the useful life of a tee.

It is an object of the invention to provide improved elements and arrangements thereof in a tee tether for the purposes described which is lightweight in construction, inexpensive to manufacture, and dependable in use.

Briefly, the tee tether in accordance with this invention achieves the intended objects by featuring: a retaining clip for fastening to a golf tee, an anchoring peg for insertion into the ground remote from the clip, and a flexible cord connecting the clip and peg. The clip includes a lower member having a receptacle with an aperture for receiving the head of a tee and a first retaining arm extending from the receptacle. The clip also includes an upper member having a cap normally positioned above the receptacle and a second retaining arm extending from the cap to a distal end joined to the first retaining arm. The cap has a concavity in its top for receiving and supporting a golf ball and has a projection extending from its bottom for engaging the top of a tee. The anchoring peg, however, has a spike and a crosspiece with upwardly bowed ends for easy handling. The flexible cord is provided with ruled markings.

The foregoing and other objects, features and advantages of the present invention will become readily apparent upon further review of the following detailed description of the preferred embodiment as illustrated in the accompanying drawings.

BRIEF DESCRIPTION OF THE DRAWINGS

The present invention may be more readily described with reference to the accompanying drawings, in which.

Similar reference characters denote corresponding features consistently throughout the accompanying drawings.

DETAILED DESCRIPTION OF THE PREFERRED EMBODIMENT

Figure 1:
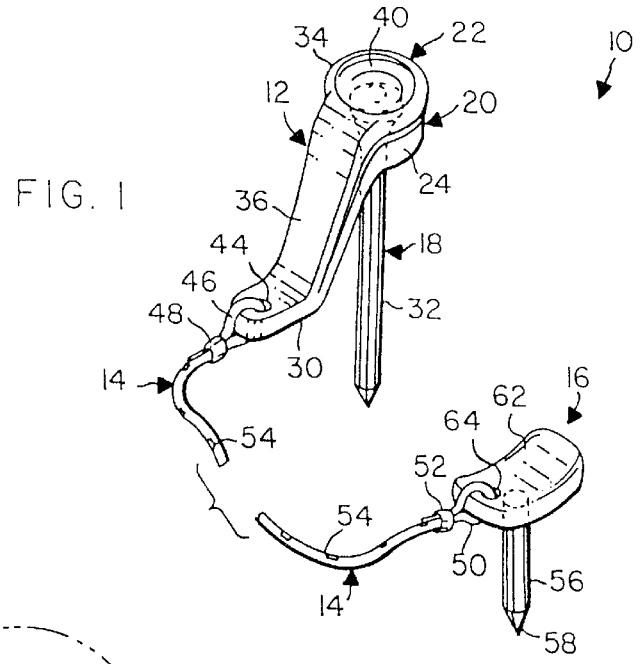
FIG. 1 is a perspective view of a golf tee tether in accordance with the present invention.

Referring now to the FIGS., a tee tether in accordance with the present invention is shown at 10. Tee tether 10 includes a retaining clip 12 secured by means of a flexible cord 14 to an anchoring peg 16. In use, a golf tee 18 held by clip 12 will travel no further than the length of cord 14 when struck thus permitting tee 18 to be easily retrieved and reused by a golfer.

Retaining clip 12 includes a lower member 20 and an upper member 22 that are attached to one another at their respective inner ends. Lower member 20 has a receptacle 24 at its outer end with a conical aperture 26 for snugly receiving the head 28 of tee 18. A retaining arm 30 extends both outwardly and downwardly from receptacle 24 to a location opposite the midpoint of the shaft 32 of tee 18. Upper member 22, however, has a cap 34 at its outer end that is normally positioned above receptacle 24. A retaining arm 36 extends outwardly and downwardly from cap 24 substantially parallel to arm 30. Lower member 20 and upper member 22 of clip 12 are preferably formed as a unitary body as shown in the FIGS.

Cap 34 is configured to support a golf ball 38 and snugly engage the top of the head 28 of tee 18. As shown, cap 34 is provided with a recess or concavity 40 in its top into which may be positioned the bottom of ball 38. On the other hand, the bottom of cap 34 is provided with a shallow projection 42 of convex form for positioning against the top of head 28 of tee 18 having a corresponding shape.

Axially aligned holes 44 are provided in upper and lower members 20 and 22 at their point of attachment. Through holes 44 is extended one end of flexible cord 14 that is folded back upon itself so as to form a loop 46 around a portion of arms 30 and 36. A collar 48 positioned around adjacent portions of the folded back cord 14 permanently maintains Loop 46. The opposite end of cord 14 is similarly provided with a loop 50 maintained by a collar 52.

Flexible cord 14 may be formed of string, non-corrosive wire, or any other material that is resistant to moisture and capable of withstanding the tensile loads imparted by a golf club on retaining clip 12. So that a golfer can determine the appropriate distance from his feet to retaining clip 12, cord 14 is provided with ruled markings 54 along its length which may be provided every ½ inch or other suitable interval. Numerals (not shown) may also be provided on cord 14 to assist a golfer in counting markings 54.

Anchoring peg 16 is captured by loop 50 in cord 14. Anchoring peg 16 includes a spike 56 with a sharpened bottom end 58 for insertion into the earth's surface 60. A crosspiece 62 is affixed to the top of spike 56 to permit spike 56 to be manipulated. Preferably, crosspiece 62 has an upwardly bowed configuration like a shallow "U" to permit a golfer to easily position his fingers beneath crosspiece 62 to extract spike 56 from the surface 60. A hole 64 in one end of crosspiece 62 receives loop 50.

Figure 2:
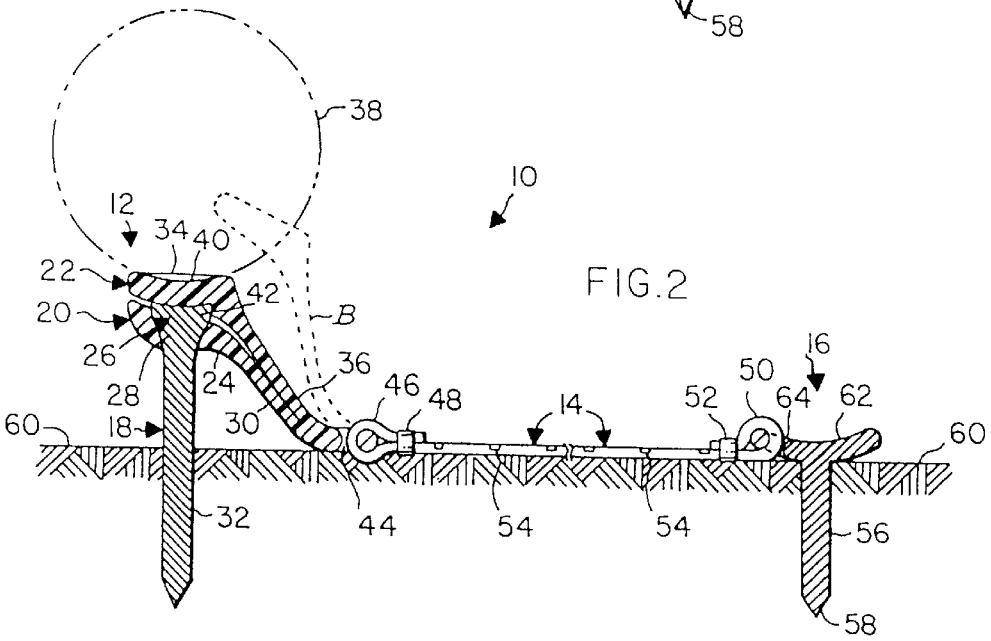
FIG. 2 is a longitudinal cross-sectional view of the tee tether of FIG. 1.

Use of tee tether 10 is straightforward. First, tee 18 is inserted into receptacle 24 of clip 12 by rotating upper member 22, formed of resilient plastic, to broken line position B in FIG. 2 and, then, dropping tee 18 shaft-first into aperture 26. Next, upper member 22 is released to permit such to return to the solid line position shown in FIG. 2 wherein head 28 of tee 18 is firmly grasped between upper and lower members 20 and 22. Later, with ball 38 positioned in recess 40, shaft 32 of tee 18 is inserted into earth's surface 60. (The inner end of clip 12, when brought into close proximity with surface 60, serves as a guide for the proper height of ball 38.) Then, in the normal case, cord 14 is extended perpendicularly to the intended flight path of ball 38 and spike 56 is driven into surface to maintain the position of cord 14. Now, using the ruled markings 54 on cord 14, a golfer positions his feet the appropriate distance from retaining clip 12 and swings his club to drive ball 38 from atop tee 18. With cord 14 securing clip 12 to anchoring peg 16, tee 18 cannot travel farther than the length of cord 14 even if struck flush with a golf club. Tee 18, thus, cannot be lost during use of tee tether 10.

While the invention has been described with a high degree of particularity, it will be appreciated by those skilled in the art that modifications may be made thereto. For example, upper and lower members 20 and 22 of clip 12 need not be formed as a unitary body as illustrated in the FIGS., but may be separately molded and adhesively or otherwise attached at their outer ends. Therefore, it is to be understood that the present invention is not limited to the sole embodiment described above, but encompasses any and all embodiments within the scope of the following claims.

I claim:

1. A golf tee tether, comprising:

a retaining clip for fastening to a golf tee, said retaining clip including:

a lower member having a receptacle at its outer end with a conical aperture for snugly receiving the head of a golf tee and a first retaining arm extending from said receptacle and terminating at a first end; and, an upper member having a cap normally positioned above said receptacle and a second retaining arm extending from said cap substantially parallel to said first retaining arm and terminating at a second end, said first end and said second end being secured together, said cap having a concavity in its top for receiving and supporting a golf ball;

an anchoring peg for insertion into the ground remote from said retaining clip; and, a flexible cord connecting said retaining clip and said anchoring peg together.

2. The tee tether according to claim 1 wherein said flexible cord is provided with ruled markings along its length.

3. A golf tee tether, comprising:

a retaining clip for fastening to a golf tee, said retaining clip including:

a lower member having a receptacle at its outer end with a conical aperture for snugly receiving the head of a golf tee and a first retaining arm extending from said receptacle and terminating at a first end; and, an upper member having a cap normally positioned above said receptacle and a second retaining arm extending from said cap substantially parallel to said first retaining arm and terminating at a second end, said first end and said second end being secured together, said cap having a concavity in its top for receiving and supporting a golf ball, said cap also having a projection extending from its bottom for snug engagement with the top of a golf tee;

an anchoring peg for insertion into the ground remote from said retaining clip; and, a flexible cord connecting said retaining clip and said anchoring peg together.

4. The tee tether according to claim 3 wherein said flexible cord is provided with ruled markings along its length.

5. A golf tee tether, comprising:

a retaining clip for fastening to a golf tee, said retaining clip including:

a lower member having a receptacle at its outer end with a conical aperture for snugly receiving the head of a golf tee and a first retaining arm extending from said receptacle and terminating at a first end; and, an upper member having a cap normally positioned above said receptacle and a second retaining arm extending from said cap substantially parallel to said first retaining arm and terminating at a second end, said first end and said second end being secured together, said cap having a concavity in its top for receiving and supporting a golf ball, said cap also having a projection extending from its bottom for snug engagement with the top of a golf tee;

an anchoring peg for insertion into the ground remote from said retaining clip, said anchoring peg including:

a spike with a sharpened bottom end; and, a crosspiece, with upwardly bowed ends, affixed to the top of said spike; and, a flexible cord connecting said retaining clip and said anchoring peg together.

6. The tee tether according to claim 5 wherein said flexible cord is provided with ruled markings along its length.

7. A golf tee tether, comprising:

a retaining clip including:

a lower member having an aperture sized to permit the downward passage of shaft of a golf tee yet prevent the downward passage of the head of the tee so as to retain the head of the golf tee atop said lower member with shaft of the golf tee extending below said lower member; and, an upper member hingedly attached to said lower member, said upper member having a cap normally positioned above said aperture for supporting a golf ball at a fixed height above the head of the golf tee in said aperture;

an anchoring peg for insertion into the ground remote from said retaining clip; and, a flexible cord connecting said retaining clip and said anchoring peg together.

* * * * *